United States Patent [19]

Barker et al.

[11] Patent Number: 4,519,700

[45] Date of Patent: May 28, 1985

[54] ELECTRONICALLY GATED PAPER ALIGNER SYSTEM

[75] Inventors: Robert B. Barker, Raleigh, N.C.; Ronald V. Davidge, Delray Beach, Fla.; David K. Gibson; George W. Van Cleave, both of Boulder, Colo.

[73] Assignee: International Business Machines Corporation, Armonk, N.Y.

[21] Appl. No.: 566,236

[22] Filed: Dec. 28, 1983

[51] Int. Cl.[3] ..... G03G 15/00

[52] U.S. Cl. ..... 355/3 SH; 355/1; 355/14 SH; 271/226; 271/248; 271/258; 271/270; 346/76 L; 358/296; 358/300

[58] Field of Search ..... 355/1, 3 SH, 14 SH; 271/226, 227, 248, 250, 256, 258, 259, 270; 346/76 L; 358/296, 300

[56] References Cited

U.S. PATENT DOCUMENTS

| | | | |
|---|---|---|---|
| 3,328,658 | 6/1967 | Thompson | 318/138 |
| 3,741,357 | 6/1973 | Krysiuk et al. | 192/12 D |
| 3,888,579 | 6/1975 | Rodek et al. | 355/14 |
| 4,310,236 | 1/1982 | Connin | 355/14 |
| 4,316,667 | 2/1982 | Edwards et al. | 355/3 |
| 4,334,759 | 6/1982 | Clausing | 355/3 SH |
| 4,350,439 | 9/1982 | Tanioka et al. | 271/226 X |
| 4,408,861 | 10/1983 | Hukuda et al. | 355/14 SH X |
| 4,416,534 | 11/1983 | Kluger | 355/14 SH |
| 4,417,806 | 11/1983 | Tani et al. | 355/14 SH |

OTHER PUBLICATIONS

Xerox Disclosure Journal, by John Looney, vol. 1, No. 5, May 1976, "Copy Sheet Registration System", pp. 85, 86.

IBM Technical Disclosure Bulletin, vol. 22, No. 12, May 1980, "Servo-Controlled Paper Gate", by J. L. Cochran & J. A. Valent, pp. 5268-5269.

*Primary Examiner*—A. C. Prescott

*Attorney, Agent, or Firm*—Earl C. Hancock

[57] ABSTRACT

In a xerographic image transfer device, copy sheets are sequentially aligned and position sensed before introduction to the image transfer zone. The position sensing is used to compare the copy sheet location with the position of the image panel on a moving photoconductor. The timing and velocity profile of the copy sheet drive after the position sensing is arranged so that the copy sheet arrives in registry with the image panel and at the same velocity.

14 Claims, 10 Drawing Figures

ELECTRONICALLY GATED PAPER ALIGNER SYSTEM

BACKGROUND OF THE INVENTION

Cross-Reference to Related Application

Application Ser. No. 06/262,727 filed May 11, 1981 for "Document Feeder Electronic Registration Gate" by D. F. Colglazier, D. M. Janssen, J. P. Mantey, and J. A. Valent, which is assigned to the same assignee as this application, shows an arrangement for electronically aligning original document sheets with reference lines on a document copying platen for copier/duplicators using a digitally determined velocity profile and document sensing structure.

Field of the Invention

The present invention relates to methods and apparatus for control of movement of sheets so as to properly register with image transfer areas associated with xerographic copiers, printers and the like. More particularly, the present invention relates to methods and apparatus for moving copy sheets in a manner so as to align and synchronize movement of the paper with toned electrostatic images associated with xerographic apparatus.

Description of the Prior Art

In prior art xerographic or electrostatic copiers and printers, copy sheets are extracted from a source and fed against mechanical gates where they await release for introduction to a transfer zone relative to the image area on a moving photoconductor. Typically, the gate actuation is controlled by mechanical cams and switches, or the like, so that the copy sheet is driven by pinch rollers into registry with the image area as it passes a transfer corona, and with the pinch roller velocity arranged to move the paper at the same speed as the drum or belt containing the photoconductor.

Some paper feed configurations for such xerographic devices employ digital circuitry to monitor the image position and to control operation of the mechanical release gates and pinch roller drives. One example is shown in the IBM TECHNICAL DISCLOSURE BULLETIN of May 1980 (Volume 22, No. 12) in the article entitled "Servo-Controlled Paper Gate" by J. L. Cochran and J. A. Valent at pages 5268–5269. Digital circuitry shown in this article monitors the photoconductor image frame location and controls actuation of a mechanical copy sheet gate as well as D.C. motor drive for the copy sheet to bring this copy sheet up to the photoconductor speed as it engages the image panel.

Yet another application of digital control logic and circuitry for copy sheet alignment is shown in U.S. Pat. No. 4,310,236 by J. L. Connin filed Oct. 12, 1979, wherein stepper motors are used to position mechanical gates so that the copy sheets are fed with a skew that conforms to the original document skew as it was imaged onto a photoconductor belt. A logic and control unit monitors the photoconductor image location as it moves, and digitally compensates for the skew as measured by sensors at the original document when it was imaged onto the photoconductor.

It is also known to utilize stepper motors to control the movement and positioning of original documents presented for scanning by a copier. One example is U.S. Pat. No. 3,888,579 by V. Rodek et al. filed Jan. 31, 1974, wherein a combination of stepper motors and rollers, sheet detectors and controls function to release the original document so that the document image correlates to a predetermined image area on the photoconductor. Thus, it is known to monitor the photoconductor image zone location and to photocell sense the movement of an original document to control release of that document so that it passes a scan window with a velocity compatible with the photoconductor velocity and further with the proper timing to place the original document image in the predetermined image zone on the moving photoconductor.

Frequently, original documents fed to the imaging station are aligned with a mechanical reference edge as they are introduced to the scan window or platen. As a result, skewing of the original image onto the photoconductor because of original document skew is an infrequent occurrence. An example of an aligning system particularly useful in conjunction with a recirculating document feed is shown in U.S. Pat. No. 4,316,667 by E. G. Edwards, J. T. Robinson and B. L. Wilzbach filed Feb. 19, 1980. Thus, accommodation of original document skew by the copy sheet is generally not required, although the copy sheet requires alignment relative to the document feed path as it is introduced to the photoconductor so that it will properly register with the image panel on the photoconductor. Typical prior art resolutions of this problem are the aforementioned mechanical gate fingers to cause leading edge registry.

Unfortunately, the prior art systems cause slippage or scrubbing of the copy sheet by the drive belt or pinch rollers while it is awaiting release to the image area. In addition, the mechanical fingers cause bending or buckling of the leading edge of the paper (particularly for lightweight paper) when driven into these rigid stops, and the buckling further produces potential registration errors when the gates are released. Still further, the roller and gate release arrangements require careful correlation of the drive speed with the photoconductor to prevent degradation of the image transfer because of speed differentials between the copy sheet feed and the photoconductor movement.

The present invention overcomes the aforementioned problems associated with the prior art in a reliable, precise manner as described below.

DISCLOSURE OF THE INVENTION

The present invention relates to a sheet handling device which is adapted to feed sheets in synchronism with an image on the surface of a moving photoconductor. A conveyor operates to transport the sheets along a predetermined path toward the photoconductor and in parallel alignment with the path. A sensor disposed relative to the predetermined path generates a first signal representative of the passing of the sheet along that path. A second signal is generated corresponding to the location of the image zone on the photoconductor. A controller responds to the first and second signals for controlling the velocity of the conveyor for synchronously engaging the sheet with the photoconductor image zone as the sheet exits the predetermined path.

The conveyor includes an arrangement for aligning the sheets with a reference line that is parallel to the conveyor path. Ideally, the sensor is positioned for detecting passage of the sheets along the path subsequent to alignment by the aligning arrangement of the conveyor. In one form, the aligner is a surface extending above the path, with the conveyor arranged to direct sheets so that their side edges engage the aligner surface as the sheets are conveyed toward the photoconductor. Vacuum belt transports are particularly well suited for the conveyor. By using stepper motors to drive the vacuum belt transport, the controller can introduce sequences of pulses to the stepper motor to cause the vacuum belt transport velocity to match the photoconductor velocity as each sheet exits the vacuum belt at the photoconductor.

The present invention is particularly well suited for implementation by means of digital circuitry and microprocessor computer control structure and processes.

Those having normal skill in the art will readily recognize the foregoing and other objects, features, advantages and applications of the present invention in the light of the following more detailed description of the exemplary preferred embodiment as illustrated in the accompanying drawings.

DETAILED DESCRIPTION OF THE PREFERRED EMBODIMENT

The exemplary preferred embodiment is described as a xerographic printer. However, the invention is equally suited for use in a xerographic copier environment or in a machine having both printing and copying capabilities.

Figure 1:
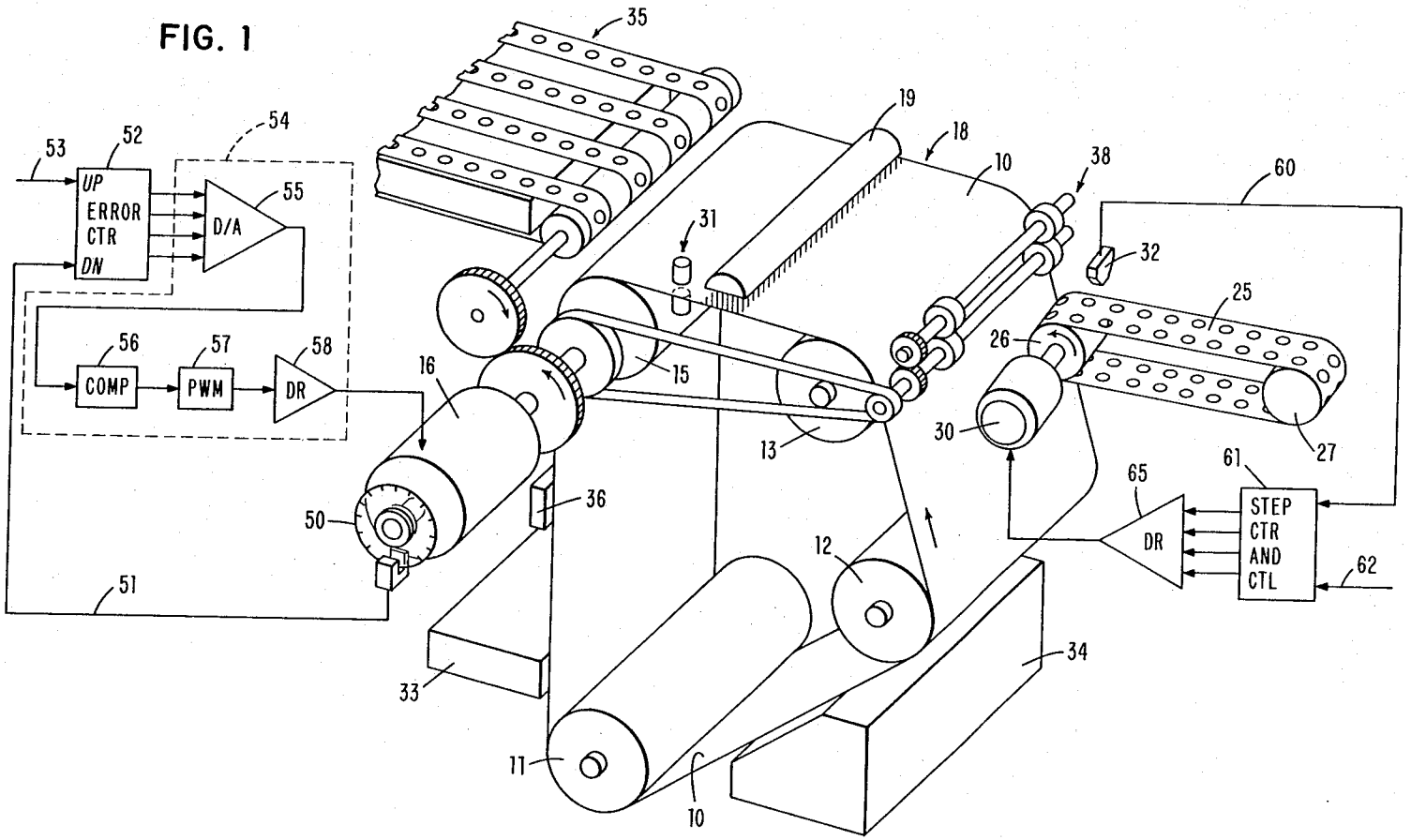
FIG. 1 is a schematic view of the elements of a photoconductor belt system and the control circuitry associated therewith in accordance with the present invention.

FIG. 1 illustrates in generally schematic form a system for aligning precut sheets of paper with a toned electrostatic image in an electrophotographic printer for the purpose of transferring the toned image to the paper. Closed loop belt 10 has a photoconductor surface thereon and receives an image, such as from a printhead, optical scanner or the like, in a conventional manner. Belt 10 is in the form of a closed loop around idler rollers 11, 12 and 13 and is driven by powered roller 15. A D.C. motor 16 is coupled to drive roller 15 and, thus, causes belt 10 to continuously move in a generally counterclockwise direction as seen in FIG. 1.

Copy sheets, by means described later herein, are introduced from the right to the left across the upper area 18 of the belt 10, and pass through a transfer zone 19 which is shown with a corona to perform the transfer function.

Figure 3:
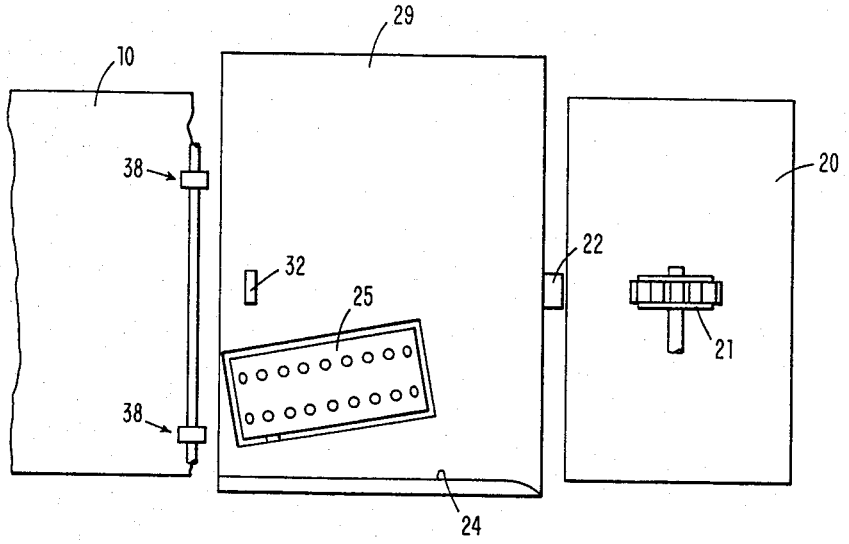
FIG. 3 is a top view generally showing the interrelationship between a copy sheet supply cassette and the aligner vacuum belt transport arrangement of the FIG. 1 system.
Figure 4:
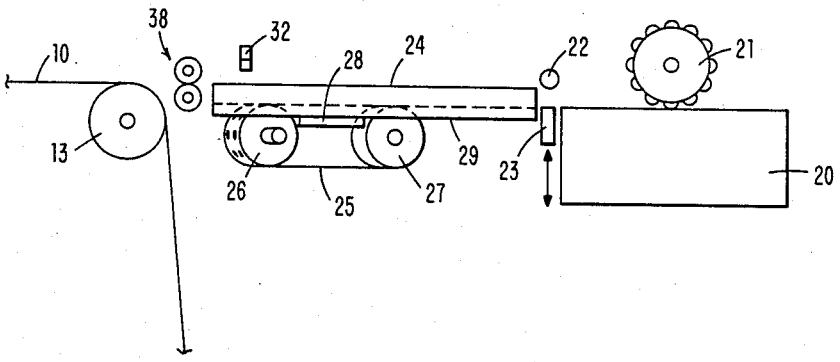
FIG. 4 is a side, partially broken view of the FIG. 3 structure.

FIGS. 3 and 4 illustrate the copy sheet source arrangement and, more particularly, supply cassette 20 which has shingler roller 21 to feed sheets from cassette 20 and deliver them to vacuum belt 25 positioned in a slot in guide plate 29. Note that other devices, such as corner bucklers or the like, are suitable for sheet feeding from cassette 20. Roller 22 and vertically movable block 23 (note the arrow below block 23 indicating its movement direction) cooperate to prevent double sheet feeding. That is, block 23 is lowered until the leading edge of a shingled sheet is in the gap between 22 and 23 at which time block 23 moves upward to pinch the sheet. Block 23 is fixed in position and operates to prevent the lower sheet from passing while roller 22 is powered or freely rotatable. Belt 25 is oriented in the upper surface of plate 29 at a slight angle (exaggerated in FIG. 3) with respect to a reference guide 24 which has an inner surface parallel to the path between cassette 20 and photoconductor 10, and extending at least slightly upwardly from the plane of belt 25 and plate 29 in that path. Vacuum belt 25 is formed as a continuous loop around driven roller 26 and idler roller 27 and over a conventional vacuum plenum 28. Roller 26 is driven by stepper motor 30 shown in FIG. 1.

A photodetector assembly 32, including a light source and photodetector to respond to the presence of a paper or the like transported by belt 25, is located downstream in the paper path defined by belt 25 and plate 29 so that copy sheets sensed by sensor assembly 32 are fully aligned with the reference guide 24 prior to arrival at sensor assembly 32.

In operation, a sheet of paper is fed onto plate 29 and thence onto moving belt 25 from cassette 20 and driven both toward photoconductor 10 and against the reference guide 24 inner surface which is parallel to the desired direction of paper motion. As the paper contacts the inner surface of reference guide 24, it slips laterally on the belt as necessary to bring its edge into contact with the guide along its entire length. This process aligns one edge of the sheet with the desired direction of motion in that the sheet is aligned laterally with the approaching toned image zone on belt 10.

When the leading edge of the sheet reaches sensor 32, motor 30 decelerates belt 25 to a stop. By selecting motor 30 and the associated sheet feed components so that motor 30 will respond to every stepping pulse under the full range of anticipated operating conditions, the relative positions of the copy sheet and photoconductor belt 10 are known. If desired, the location of the copy sheet is detectable by counting the steps taken by motor 30, which is a high resolution stepper motor, before belt 25 is completely stopped after the sensor 32 detects the leading edge of the sheet transported by belt 25. This count is then available to shift the acceleration profile (described later) when the belt 25 motion is restarted. The assembly, including belt 25, holds the sheet in a fixed position after belt 25 stops until the toned image in the image zone on photoconductor belt 10 arrives at a predetermined point on its path. At this time, motor 30 accelerates belt 25 with the sheet of paper until it reaches the same velocity as the toned image, and maintains that velocity as the sheet merges with the image and in registry with that image.

In the example of the present embodiment, location of the image zone on photoconductor 10 is determined in response to photodetector assembly 31 shown in FIG. 1. In this case, a hole or transparent window in the outer edge of belt 10, passing between the light source and photodetector of assembly 31, generates a master synchronization control signal. Use of multiple edge holes on belt 10 is possible such as in the situation where multiple successive images are placed on belt 10. In the embodiment shown, the pulse from assembly 31 is used to start a counting function to control operation of the printing device 33. The pulse from assembly 31 also directly or indirectly coordinates copy sheet feeding as is described later.

Subsequent sheets of a print job or request can follow the initial sheet and thus the motor may continue running in preparation for receiving and aligning that subsequent sheet. During acceleration, the sheet position is controlled to ensure that the leading edge of the paper and the toned image coincide. In the example of the present embodiment, this is accomplished by counting steps and controlling the times between steps of the stepper motor 30. Digital stepper motor controls are generally known, and examples of some stepper motor acceleration and deceleration controls using binary circuitry are shown in U.S. Pat. No. 3,328,658 by L. J. Thompson filed July 2, 1964.

A preselected image zone on belt 10 receives an image, such as from a laser, a light-emitting diode array or other printhead device, shown generally at 33. The image on belt 10 is subsequently developed by developer 34 so that the toned image arrives at the transfer area 19 ready for transfer to the copy sheet. A charge corona 36 places a charge on belt 10 so that it is ready to receive the image from printhead or document scanning optics at 33. Although not shown, other electrophotographic conventional elements are includable in the system, as is well known, such as discharging lamps, cleaning stations and the like.

Photoconductor belt drive motor 16 is coupled by a suitable arrangement to pinch roller array 38. Thus, as vacuum belt 25 accelerates and reaches the same velocity as photoconductor belt 10, the pinch roller array 38 retains the sheet so that it engages the surface of photoconductor 10 in the upper surface area 18 and passes under a transfer corona 19 in the transfer zone. Ultimately, the copy sheet is engaged by the lower surface of vacuum transport 35 so as not to disturb the transferred toner. Belt 35 delivers the sheet to a conventional fuser arrangement and thence to an output bay, collator or the like (not shown). If the upper area 18 is of adequately narrow width, pinch rollers 38 are not required and simple passive guideways are satisfactory for retaining the copy sheets against the surface of photoconductor 10 in registry with the image zone or panels thereon.

Figure 2:
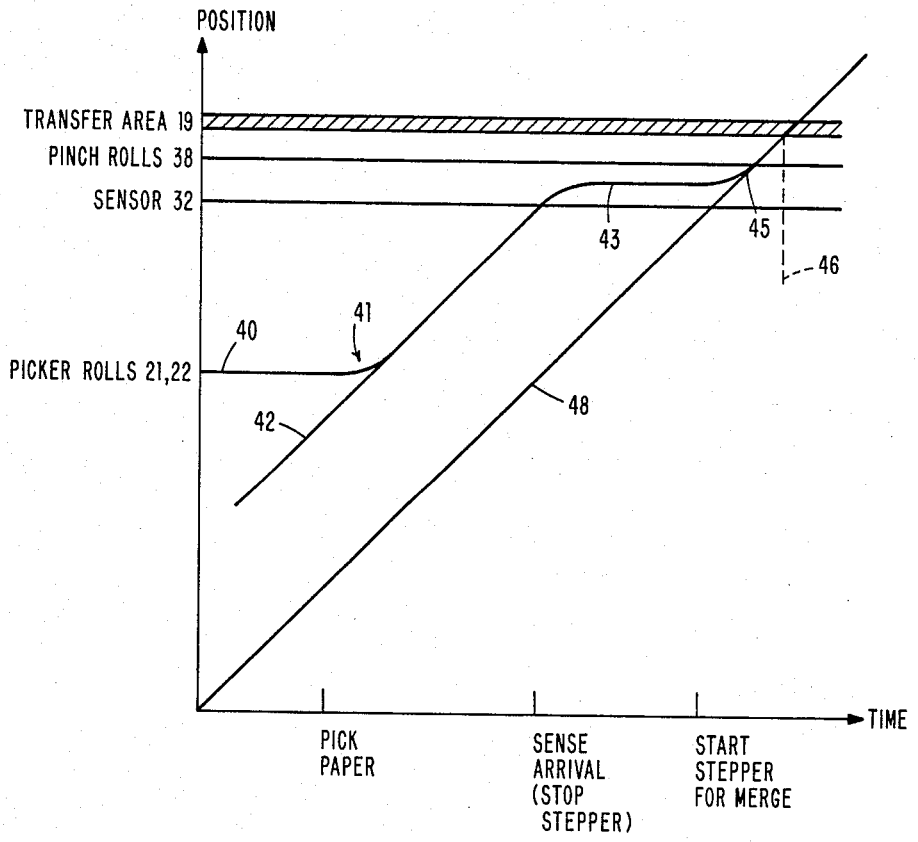
FIG. 2 is a position diagram illustrating the movement of the elements of the FIG. 1 configuration as a function of time.

FIG. 2 illustrates velocity profiles of various elements in a somewhat symbolic arrangement plotting events as a function of time and positions. Curve 40 illustrates the movement of the copy sheet leading edge which is initially static until it is picked by the cassette picker rollers 21, 22 at time 41. At that point, the paper is transported by the aligner/vacuum belt 25 and follows the movement curve 42 until the sensor 32 detects arrival of the paper leading edge. At 43, the motion of both the belt and the copy sheet is stopped. The controller senses the imminent arrival of the image panel on photoconductor 10 and accelerates the stepper motor so that the copy sheet and photoconductor belt image panel merge at point 45. Thereafter, the image transfer commences, as illustrated by line 46, as the copy sheet passes through the transfer area. Thus, line 48 represents the motion of the leading edge of the developed image on photoconductor belt 10 until point 45 is reached and thereafter represents the concurrent motion of both the belt 10 and the properly registered copy sheet.

As shown in FIG. 1, photoconductor belt 10 is driven by a D.C. motor 16 which, in turn, actuates an encoder 50 to produce an output on line 51 indicating incremental movement of belt 10. This output is introduced as a down count to error counter 52. Counter 52 counts up in response to a pulse train received from the imaging device 33 (a laser in this particular example) on input 53. This pulse train indicates the desired motion of belt 10. Thus, error counter 52 maintains a dynamic count of the cumulative difference between the number of pulses received on inputs 51 and 53, each of which represents a number of lines of the image raster and the number of encoder 50 pulses. This difference count is used to reduce this position error to zero. The output of error counter 52 is coupled to analog circuit configuration 54 including a digital-to-analog converter 55, a compensation circuit 56 which, in turn, drives a pulse width modulator (PWM) 57 which ultimately provides an input to driver circuit 58 that drives D.C. motor 16. Compensation network 56 provides lead compensation (a derivative of the position error representing velocity) which is combined with the position error to achieve the desired dynamic characteristics for the servo.

Figure 6:
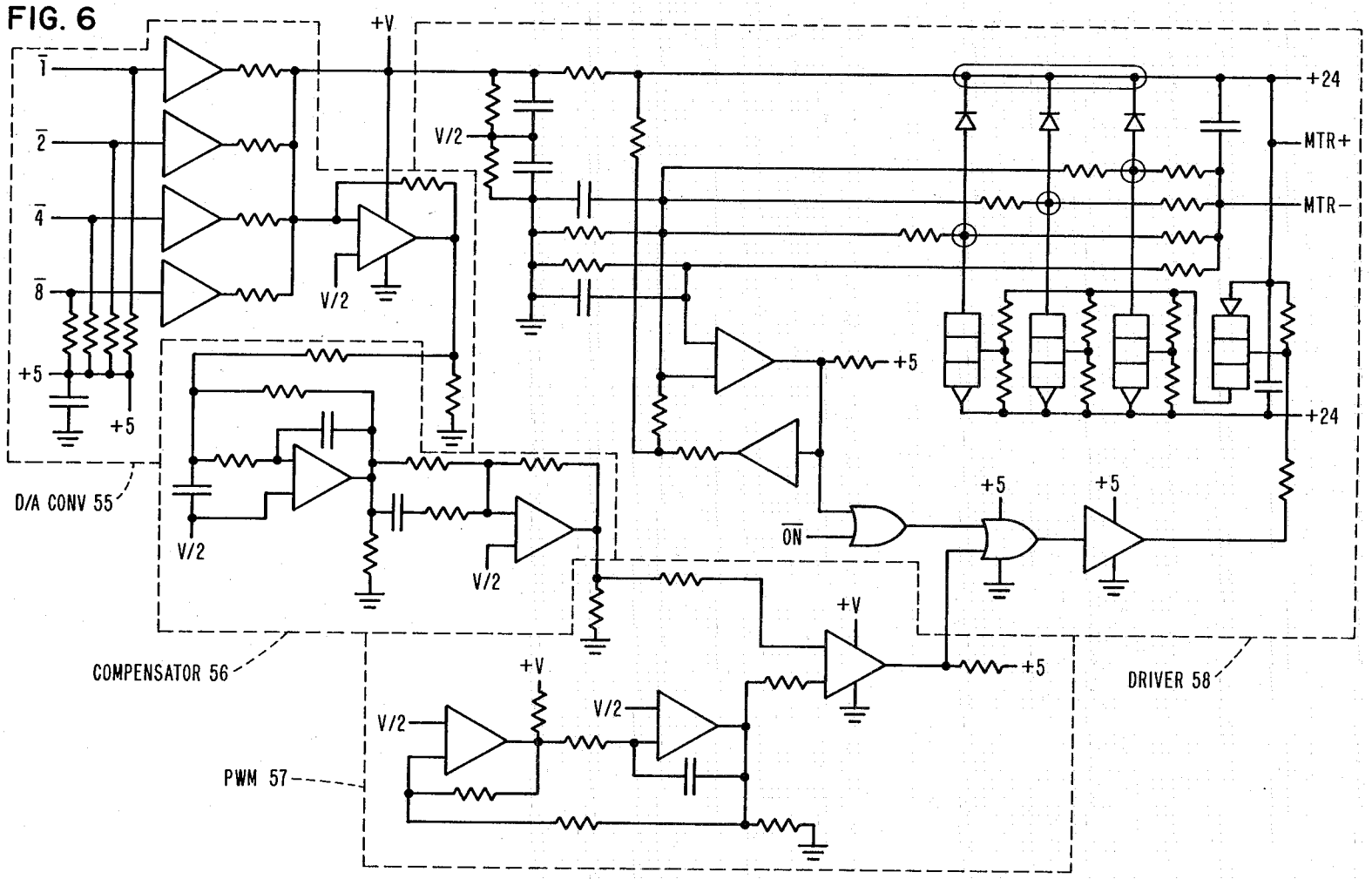
FIG. 6 is a schematic diagram of the photoconductor belt drive controls.

Pulse width modulator 57 converts the compensated analog error signal into a train of pulses whose width, or duty cycle, represents the proportion of the driver supply voltage applied to motor 16. The use of PWM 57 permits high current driver 58 to always operate either on or off to minimize power dissipation. Although FIG. 1 is considered adequate for those having normal skill in the art, FIG. 6 is a detail schematic diagram of exemplary circuits for the photoconductor belt drive system correlated with the analog circuit board 54 of FIG. 1. These circuits are also well known to those having ordinary skill in the art.

FIG. 6 provides a means of driving the photoconductor belt 10 at a speed corresponding to that of the imaging device 33, but is not otherwise related to this invention. Driving the photoconductor belt by almost any means of reasonably constant speed is acceptable if its operation is correlated with pulses derived from the encoder 50 or from some similar source. The synchronizing pulses in this embodiment are derived from the imaging device 33 largely as a matter of convenience in troubleshooting because the paper feed runs even if the photoconductor motor 16 becomes stalled or does not run for other reasons. If desired, better accuracy in tracking the photoconductor belt 16 is obtainable by deriving the synchronizing pulses directly from the photoconductor belt encoder 50.

The output 60 of paper sensor 32 is introduced as one input to stepper motor counter and control circuit 61 (FIG. 1). The second input to circuit 61 is a signal at 62 derived from the imaging device (i.e., the controls for laser printhead 33), which provides synchronism with the photoconductor belt servo. The output of circuit 61 is provided as a multiple digital sequence of signals to driver circuit 65 which, in turn, actuates stepper motor 30.

Figure 5:
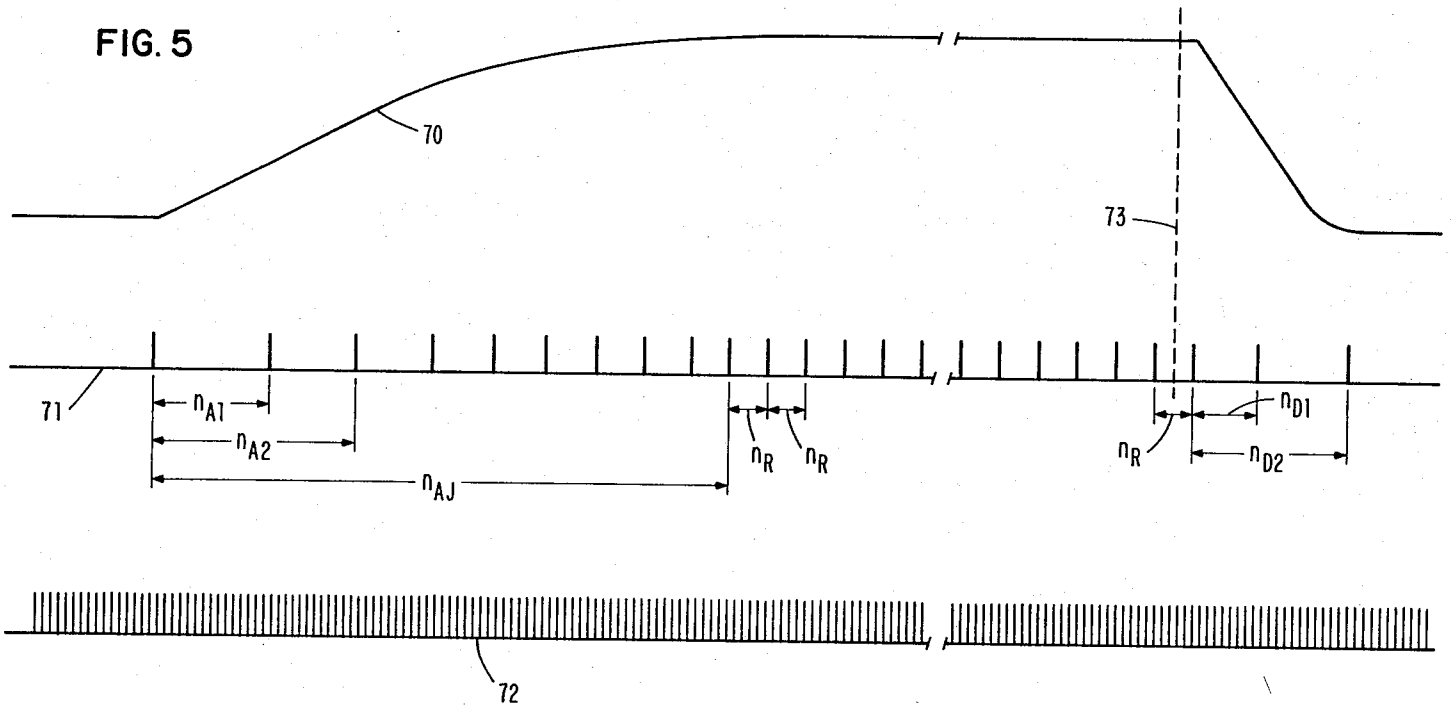
FIG. 5 is a timing diagram showing development of the stepper motor velocity profile for synchronously feeding copy sheets.

The step counter and control circuit 61 consists of a counter and associated control logic for counting the synchronizing pulses at input 62 from the imaging device (or from the photoconductor belt position encoder if more appropriate), and producing pulses which step the stepper motor 30 current from phase to phase at the appropriate time to generate the desired velocity profile at the vacuum belt 25. The timing relationships are illustrated in FIG. 5. The desired velocity profile 70 is generated by using a counter to count the synchronizing pulses 72, beginning at the particular pulse corresponding to the latent image position on the photoconductor belt, and to produce step pulses as shown along reference line 71 at the predetermined counts necessary to advance the magnetic field of the stepper motor 30 at the desired angular velocity.

In the present example, synchronizing pulses 72 are produced from the laser sweep controls generally, and from the laser mirror control in particular (both not shown). Typically, they are coordinated with the pulse from detector assembly 31 and the primary power source (i.e., 60 Hz). Pulses 72 can originate from tachometer 50 or other synchronizing pulse generating sources. As another alternative, the internal oscillator employed by a solid state light-emitting diode printhead is suitable for master clock signal generation. In the presently-described system, the laser mirror spin velocity effectively establishes the master clock used to control the speed of photoconductor belt 10 by means of input 53 to counter 52. There are a multiplicity of laser mirror sweeps for every tachometer pulse received from encoder 50. For instance, a laser sweep might correspond to only 1/4,000th of an inch of photoconductor belt 10 movement.

Regardless, synchronizing pulses 72 are at an almost constant frequency, deviating only by the variations in the speed of the imaging device 33 (or photoconductor belt as is typical for copier synchronization), and are used elsewhere in the machine to time all other functions relating to the photoconductor belt position. Since the synchronizing pulses 72 are of almost constant frequency, they serve as a clock which specifies the time between steps which are of fixed angular increments of the stepper motor 30 shaft. By specifying to the counter 61 the number of synchronizing pulses per step, the velocity of the motor 30 is specified at each step. This, of course, depends on the motor 30 having sufficient torque to allow its rotor to follow the magnetic field motion.

The counter 61 is initialized at the synchronizing pulse corresponding to the imaging on the photoconductor belt. The count is used to initiate and define the velocity profile 70 (FIG. 5) including the acceleration ramp. Various counts ($n_{A1}$, $n_{A2}$, . . . $n_{AJ}$) are decoded to produce step pulses 71 at predetermined decreasing intervals, as shown in FIG. 5, to establish the acceleration ramp. At the end of the acceleration period, which is also a predetermined count, the counter is reset after each step pulse and allowed to count back up to the same value (nR) each time a step is produced. This yields the constant velocity portion of the profile 70.

When the paper sensor signal 60 is recognized at time 73, representing arrival of the leading edge of the next copy sheet at sensor 32, the counter is reset at the next step and counts out the deceleration ramp via step pulses of programmed increasing time intervals. More particularly, during deceleration, the counts between steps become progressively longer ($n_{D1}$, $n_{D2}$) until motor 30 is at rest. Since the deceleration and acceleration ramps both consist of fixed counts, the time and distance traveled by the image, from sensor recognition to the merging of paper and image, is specified within the physical displacement associated with one step (which is adequate). The step pulses advance the motor current via conventional driver circuits 65 which are well known in the art.

FIGS. 7 through 10 are diagrams of the elements of step counter and control circuit 61. The control system represented by these diagrams is a generic combinational logic approach simplified for clarity of function. Those skilled in the art will understand necessary timing details, etc., and that other means are available to accomplish the function, such as microprocessors, programmable logic arrays, and the like.

Figure 7:
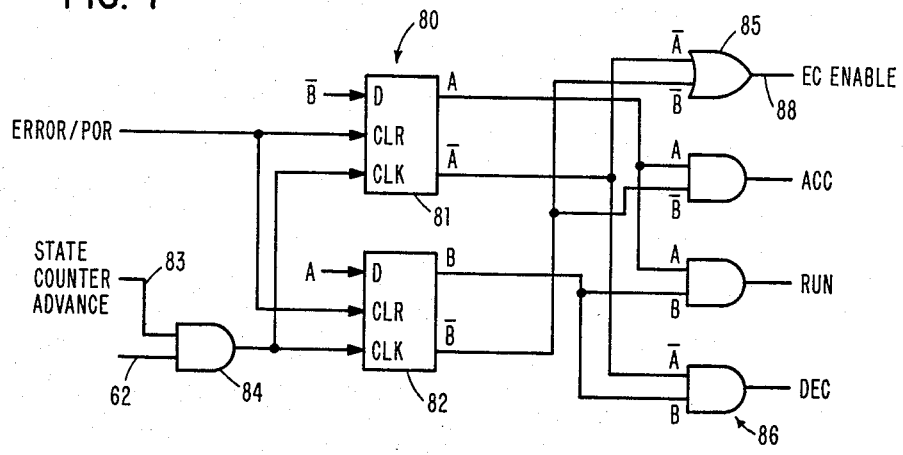

In FIG. 7, four states are defined by the state counter 80 comprised of flip-flops 81 and 82. The states consist of Standby (00 or EC ENABLE), Accelerate (ACC or 10), Run (11), and Decelerate (DEC or 01), and are sensed by decoder array 86. Counter 80 is responsive to AND 84 which produces output pulses in response to encoder pulses at input 62, and a State Counter Advance enabling input 83 which originates from the decode logic of FIG. 10 described later. The output 88 of OR 85 is the Encoder Counter (EC) Enable signal for the encoder pulse counter 90 of FIG. 8.

Figure 8:
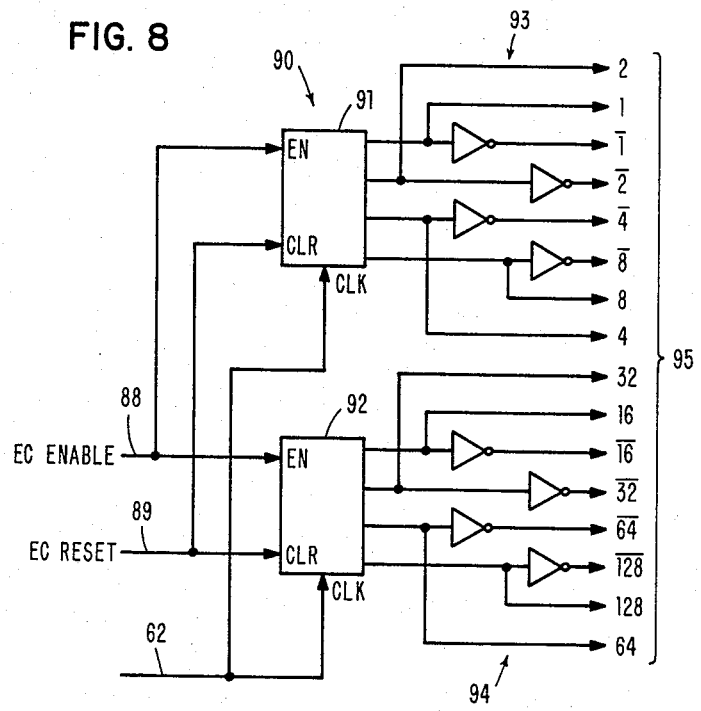

FIG. 8 shows the encoder pulse counter 90 which is active in all states except Standby. Two 4-bit counters 91 and 92 respond to the EC Enable 88 to count encoder pulses 62 and are reset by E.C. Reset 89 which is generated by the FIG. 10 decode logic. The arrays 93 and 94 of inverter circuits combined with output of counters 91 and 92, respectively, produce the eight-bit binary count configuration output 95 as shown to provide appropriate input for the encoder pulse counter decode logic of FIG. 10.

Figure 9:
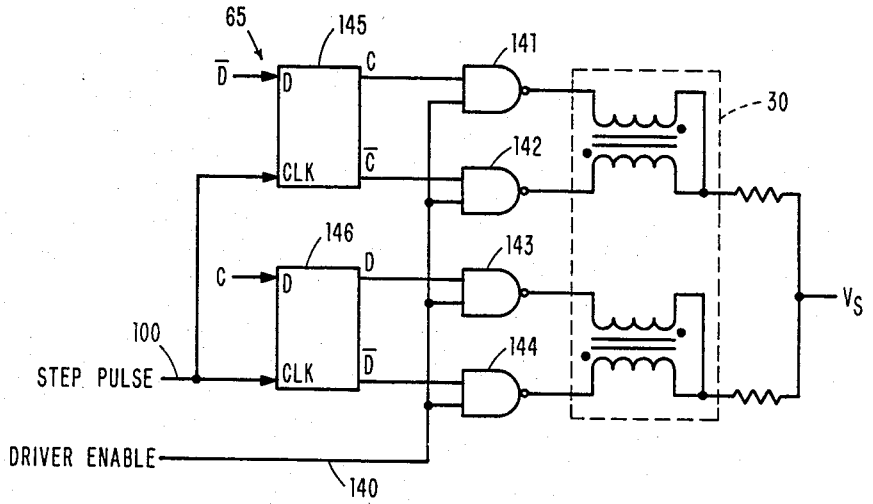
FIGS. 7–10 are circuit diagrams representing various portions of the stepper motor control circuitry 61 of FIG. 1.
Figure 10:
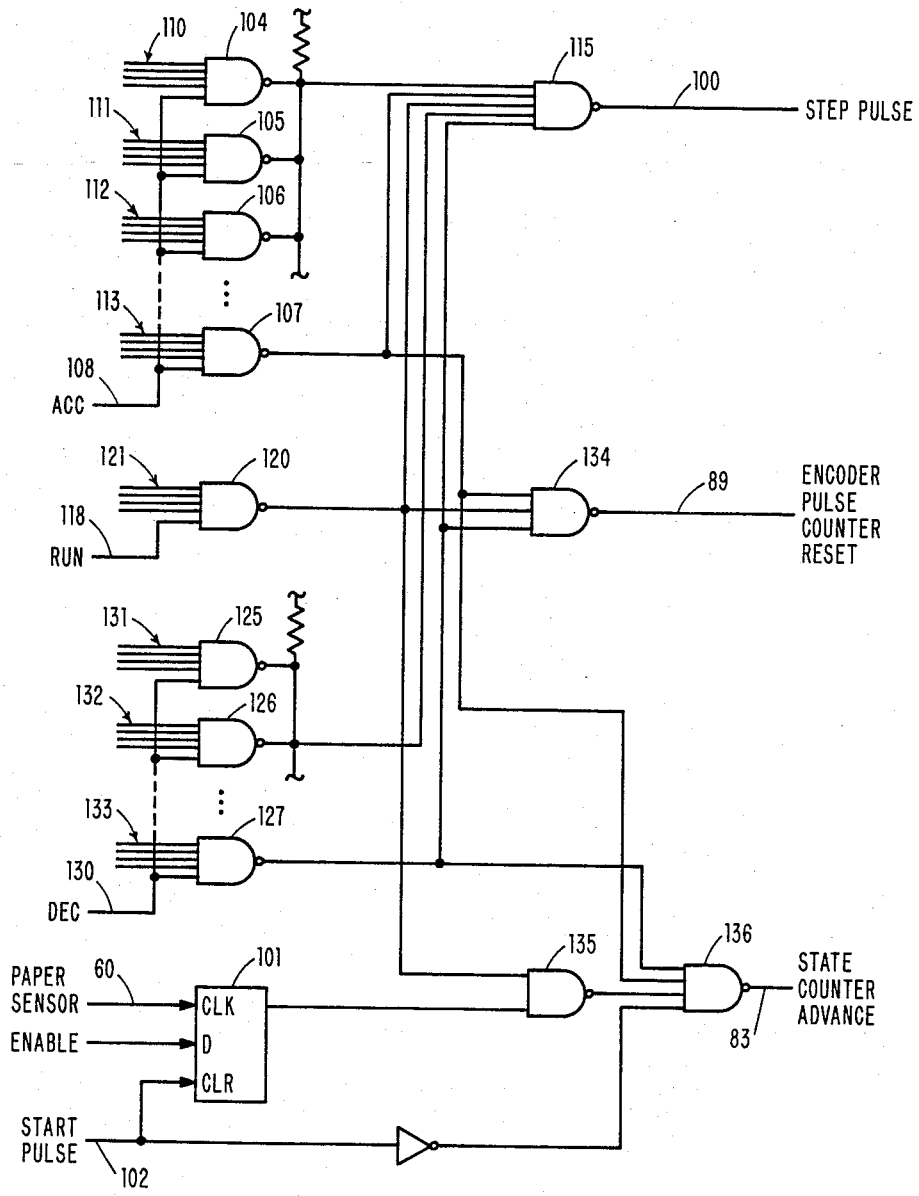

The output 95 of the encoder pulse counter 90 is decoded in FIG. 10 to produce the state counter advance signal 83, the encoder pulse counter reset 89 to reset counter 90 at the entrance to a new state, and properly spaced step pulses on output 100 to appropriately control the windings of stepper motor 30 via the FIG. 9 driver circuit 65. Latch 101 initiates the deceleration and stop sequence in recognition of the rising edge of signal 60 reflecting arrival of the paper edge at the sensor 32 (FIG. 1) as the paper approaches the holding position during a Run state. Sheet acceleration is initiated by a start pulse 102 from the machine control system timed to merge the sheet with the image on the photoconductor. The number of steps in a sequence is determined by the number of NAND gates in that section of the decode logic (e.g., 104–107 for acceleration). The count for each step is determined by the output 95 of encoder counter 90 (FIG. 8) which is chosen to provide one or more inputs for the particular gate. For acceleration mode, NANDs 104–107 produce a sequence of properly-spaced pulses when enabled by the ACC input 108, based upon inputs 110–113, respectively. Inputs 110–113 are determined by the presence of particular combinations of eight bits at the encoder pulse counter output 95 (FIG. 8). Thus, in FIG. 5, the output of NAND 104 corresponds to $n_{A1}$, 105 to $n_{A2}$, 106 to $n_{A3}$, through 107, the output of which corresponds to $n_{AJ}$. These pulses are passed through logic gate 115 to provide the acceleration sequenced step pulses at 100.

When in the Run state, input 118 enables NAND 120 which thereafter responds to a predetermined output 95 count represented by input lines 121. This causes regularly occurring step pulses $n_R$ at 100. The deceleration sequence is somewhat similarly produced by NANDs 125–127 when enabled by DEC input 130. The inputs 131–133 also represent particular counts present at output 95 (FIG. 8). The outputs correspond to $n_{D1}$ from NAND 125 to $n_{DK}$ from NAND 127. Note that the advance of the state counter 80 requires completion of each state sequence before an advance pulse 83 is produced.

Stepper operation of motor 30 is controlled by driver circuit 65 shown in FIG. 9. By means not shown, the machine control system introduces an actuating signal to the Driver Enable input 140. This partially enables each of the high current switches 141–144. As step pulses arrive on input 100 from the FIG. 10 decoder, flip-flop circuits 145 and 146 respond to produce a binary sequence of levels at their C, not-C, D and not-D, outputs. This results in appropriate sequences of output from switches 141–144 to the windings of motor 30 to cause the mechanical output of motor 30 to step with correct timing.

By the foregoing, it is apparent that dual functions are accomplished by the hardware namely in providing both copy sheet alignment and gating by means of a single mechanism with only three moving parts—the motor 30/drive roll 26, the vacuum belt 25 and the drive roll 27. No mechanical gate is required and, thus, the slippage of the paper or scrubbing of the paper on a belt or against pinch rolls while awaiting release to the image area is avoided. Further, there are no risks of bending or buckling of the copy sheet leading edge as when the sheet is driven into a rigid stop gate resulting in potential registration errors. The stepper motor drive provides precise speed and position control and is available without feedback (tachometers or the like), if desired, although closed-loop systems using tachometers are acceptable as an alternative from the open loop system shown. A direct drive is possible through the use of stepper motors without reduction gears or the like, and paper acceleration is controlled so that there are no jarring impacts or other disturbances. Relatively high reliability is accomplished due to gentle handling of the copy sheets, and a simpler mechanism is provided to accomplish the required functions. The system thus described is especially useful in high utilization machines such as high speed xerographic printers and the like.

Note that the drive for photoconductor belt 10 by motor 16 is also adaptable for use with a stepper motor. A stepper motor control somewhat like that described for the vacuum belt 25 is acceptable for replacement of D.C. motor 16 in which case, encoder 50 is not needed.

Although the present invention is described herein with particularity relative to the foregoing detailed description of an exemplary preferred embodiment, various modifications, changes, additions, and applications of the present invention in addition to those mentioned herein will readily suggest themselves to those having normal skill in the art without departing from the spirit of this invention.

What is claimed is:

1. A sheet handling device adapted to feed sheets in synchronism with an image on the surface of a moving photoconductor comprising:

conveying means operable to transport sheets along a predetermined path toward the photoconductor;

sensing means disposed relative to said predetermined path for generating a first signal representative of the passing of a sheet along said path;

means operable for generating a second signal corresponding to the location of an image zone on the photoconductor; and controller means responsive to said first and second signals for controlling the velocity of said conveying means for synchronously engaging the sheet with the photoconductor image zone as the sheet exits said predetermined path.

2. A sheet handling device in accordance with claim 1 wherein said conveying means includes means for aligning sheets with a reference line parallel to said predetermined path.

3. A sheet handling device in accordance with claim 2 wherein said sensing means is positioned for detecting passage of sheets along said path subsequent to alignment of the sheets by said aligning means.

4. A sheet handling device in accordance with claim 3 wherein said sheet aligning means is a surface extending above said predetermined path, said conveying means including means for directing the sheet side edges against said surface as the sheet is conveyed toward the photoconductor.

5. A sheet handling device in accordance with claim 4 wherein said conveying means includes a vacuum belt transport.

6. A sheet handling device in accordance with claim 5 wherein the vacuum belt of said transport is driven by a stepper motor, said controller means including means for introducing sequences of pulses to said stepper motor for causing said vacuum belt transport velocity to match the photoconductor velocity as each sheet exits said vacuum belt at the photoconductor.

7. In a xerographic device having a moving photoconductor on which an image panel is located, a source of copy sheets and means for transferring images from the panel to the copy sheets, an improvement comprising:

means for sequentially conveying copy sheets along a path from the copy sheet source, said conveying means including a belt;

means for retaining the sheets in a relatively fixed position with respect to said belt, and means for moving said belt;

means for aligning a side edge of each copy sheet on said conveying means with a reference line parallel to the direction of movement of said belt;

means producing an output signal indicative of passage of sheet leading edges past a predetermined location relative to said conveying means for sheets aligned by said aligning means; and control means monitoring movement of the photoconductor image panel and responsive to said output signal producing means for actuating said belt moving means so that the copy sheet leading edge engages the photoconductor image panel leading edge with a common velocity therebetween prior to image transfer to the copy sheet from the photoconductor by the transferring means.

8. An improved device in accordance with claim 7 wherein said sheet passage signal producing means is a photodetector device.

9. An improved device in accordance with claim 8 wherein said conveying means includes a vacuum belt transport means; and said aligning means includes a surface extending generally perpendicular to the plane of said conveying means path and extending in a direction parallel to said path.

10. An improved device in accordance with claim 9 wherein said belt moving means includes a stepper motor connected for driving said belt, said control means producing a sequence of pulses for actuating said stepper motor so that each sheet as it exits said belt engages the photoconductor image panel with the same velocity as the photoconductor.

11. An improved device in accordance with claim 10 wherein said control means includes means responsive to said sheet passage signal for decelerating said stepper motor to a stop, and means responsive to a signal coordinated with the photoconductor movement for accelerating said stepper motor to a speed corresponding to the photoconductor movement velocity.

12. An improved device in accordance with claim 11 wherein said control means maintains said stepper motor speed at said photoconductor movement velocity until occurrence of the next said sheet passage signal.

13. The method of synchronously engaging a copy sheet with an image zone of a moving photoconductor comprising the steps of:

transporting the copy sheet along a path toward the photoconductor;

sensing the arrival of the copy sheet at a predetermined location along said path;

monitoring the position of the photoconductor image zone;

determining the velocity profile for movement of the copy sheet from said predetermined location to registry with the photoconductor image zone so that the copy sheet and photoconductor move with a common velocity at the time of registry; and moving the copy sheet from said predetermined location into registry with the photoconductor image zone in conformity with said velocity profile.

14. The method in accordance with claim 13 wherein said transporting step includes the step of aligning the copy sheet into parallel relation with the direction of said path before the copy sheet arrives at said predetermined location.

* * * * *